US005816694A

United States Patent [19]

Ideker et al.

[11] Patent Number: 5,816,694

[45] Date of Patent: Oct. 6, 1998

[54] SQUARE DISTRIBUTION REFLECTOR

[75] Inventors: Barton K. Ideker; Omer E. Murray, both of Hendersonville, N.C.

[73] Assignee: General Electric Company, Schenectady, N.Y.

[21] Appl. No.: 672,902

[22] Filed: Jun. 28, 1996

[51] Int. Cl.[6] ..... F21V 7/00

[52] U.S. Cl. ..... 362/348; 362/297; 362/346; 362/349

[58] Field of Search ..... 362/297, 346–349, 362/304

[56] References Cited

U.S. PATENT DOCUMENTS

| | | | |
|---|---|---|---|
| 2,492,946 | 1/1950 | Barber | 362/348 |
| 3,710,095 | 1/1973 | Donohue et al. | 362/348 |
| 3,826,913 | 7/1974 | Downing et al. | 362/348 |
| 4,242,727 | 12/1980 | DeVos et al. | 362/346 |
| 4,670,825 | 6/1987 | Fouke | 362/346 |
| 4,979,086 | 12/1990 | Heinisch | 362/297 |
| 5,287,259 | 2/1994 | Lautzenheiser | 362/346 |
| 5,607,229 | 3/1997 | Rykowski et al. | 362/346 |

OTHER PUBLICATIONS

Hubbell Lighting Catalog (No Date).

Kim Lighting Catalog (No Date).

GE Lighting Catalog (No Date).

*Primary Examiner*—Alan Cariaso

*Attorney, Agent, or Firm*—Fay, Sharpe, Beall, Fagan, Minnich & McKee

[57] ABSTRACT

A lighting fixture having an integrally formed reflector for distributing a substantially square pattern of light and a light source extending along the reflector axis between first and second ends. The reflector has a side wall which includes four similarly shaped quadrants, each quadrant having four distinctly shaped sub-quadrants. Each of the four similarly shaped quadrants has a first sub-quadrant for distributing light from the light source toward a corner portion of the substantially square pattern of light, a second sub-quadrant for distributing light from the light source toward a side portion of the substantially square pattern of light, and third and fourth sub-quadrants for distributing light from the light source toward interior portions of the substantially square pattern of light.

20 Claims, 3 Drawing Sheets

SQUARE DISTRIBUTION REFLECTOR

BACKGROUND OF THE INVENTION

The present invention relates to the art of lighting fixtures, and more particularly to lighting fixtures for distributing square patterns of light.

In general, lighting fixtures consist of a lamp or light source, and a reflector for reflecting light from the light source. The shape of reflector defines the distribution pattern of light reflected therefrom. Normally, light is distributed in a round or circular pattern. However, lighting fixtures for distributing substantially square patterns of light are known in the art. These lighting fixtures are primarily used for area lighting, including street lighting and parking lot lighting; however, square light distribution lighting fixtures can also be used for walkways, bicycle paths, or other exterior or outdoor applications. Additionally, square light distribution lighting fixtures may be employed for interior or indoor applications. For example, the square light distribution fixtures can be used to illuminate basketball gym floors or the floors of factory buildings.

Square distribution lighting fixtures are preferred by lighting architects over round distribution lighting fixtures. To illuminate a given area, i.e., a parking lot, the lighting architect will employ a lesser number of square distribution lighting fixtures when compared to round pattern square distribution lighting fixtures. Assuming comparable costs between the two different lighting fixtures, employing square pattern distribution fixtures translates into savings. Lighting architects prefer square distribution lighting fixtures since they feel that there need not be an overlap of distribution patterns associated with round pattern distribution lighting fixtures to fully illuminate a parking lot. Additionally, lighting architects appreciate the elimination of spill light at corners of the parking lot produced by round pattern distribution lighting fixtures.

Square pattern distribution lighting fixtures of the past employ a reflector designed to reflect light from a light source attached therein, into a square pattern. In one known prior art application, the reflector is formed by riveting or otherwise fastening together several reflective panels. This method of forming the reflector is undesirable since it is labor intensive and prone to manufacturing errors.

In another prior art square light distribution, the reflector is integrally formed. This method eliminates manufacturing problems associated with riveting together several panels. These reflectors, however, are required to be shallow from top to bottom and cannot fully contain a vertically mounted, elongated light source. As a result, the light source must be mounted horizontally within the reflector and transverse to the reflector's axis. In this configuration, the resulting square light distribution pattern is severely degraded.

A further problem associated with each of the known prior art square light distribution lighting fixtures, including those using an integrally formal reflector, relates to the efficiency and effectiveness of the resulting square light pattern. In particular, prior art square pattern distribution lighting fixtures produce non-uniform distribution patterns in the form of hot spots, or dark spots. More importantly, these prior art fixtures performed poorly at distances remote from the area to be illuminated. At greater distances, the prior art lighting fixtures do not produce a true square pattern of light distribution. Oftentimes the corners were irregular.

The present invention overcomes these problems and others and when implemented, produces a square light distribution lighting fixture which produces a more efficient and diffuse light in a square pattern at greater distances.

SUMMARY OF THE INVENTION

In accordance with one aspect of the present invention, a square light distribution lighting fixture is provided which distributes a uniform and extended square light pattern using an integrally formed reflector. The reflector has a top end, a bottom end, and a side wall extending therebetween wherein the side wall is formed symmetrically with respect to a first axis, or center line, which traverses the top and bottom ends. A light source is attached to the top of the light reflector and extends along the first axis between first and second ends.

In accordance with a more limited aspect of the present invention, the side wall of the integrally formed light reflector includes a plurality of similarly shaped quadrants, where each quadrant has a plurality distinctly shaped sub-quadrants.

In accordance with another aspect of the present invention, each of the quadrants has a first sub-quadrant which distributes a corner portion of the substantially square pattern of light, a second sub-quadrant for distributing a side portion of the substantially square pattern of light, and third and fourth sub-quadrants for distributing interior portions of the substantially square pattern of light.

In accordance with yet another aspect of the present invention, each of the first sub-quadrants is defined by a surface which is paraboloidal in transverse surface directions.

In accordance with yet another aspect of the present invention, each of the second sub-quadrants is defined by a surface which is paraboloidal in a first surface direction and linear in a second surface direction wherein the first and second surface directions are transverse to each other.

In accordance with yet another aspect of the present invention, each of the third and fourth sub-quadrants are defined by a planar surface.

In accordance with yet another aspect of the present invention, each surface of the four sub-quadrants includes small radii or flutes for diffusing light reflected thereon.

One advantage of the present invention is that the light reflector can be integrally formed.

Another advantage of the present invention is that the resulting square light pattern is more uniform and extended.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION OF THE PREFERRED EMBODIMENTS

Figure 1:
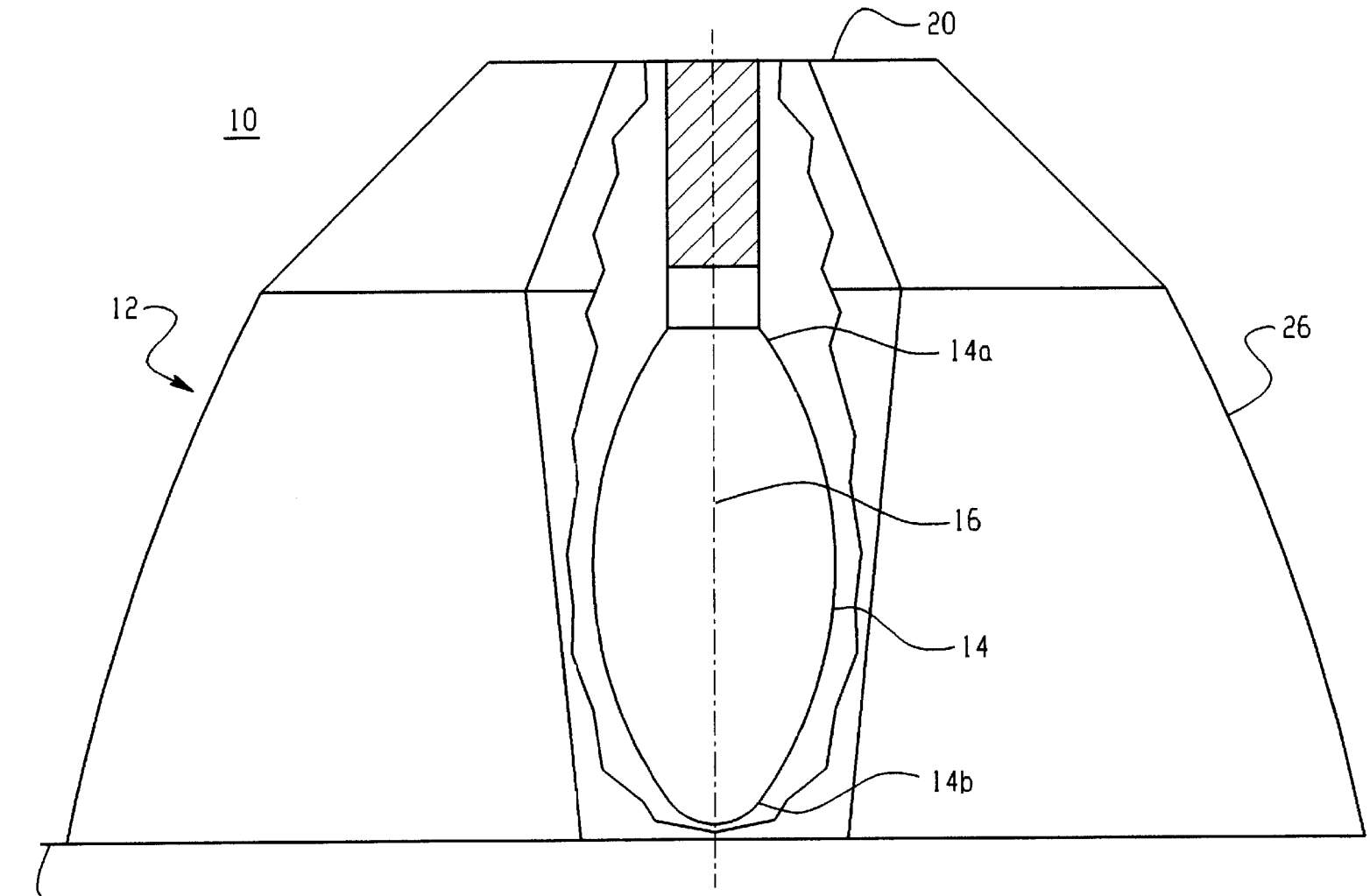
FIG. 1 is an elevational, partly in section, of the subject lighting fixture.

With reference to FIG. 1, a square light distribution lighting fixture 10 includes an integrally formed reflector 12 and a vertically mounted light source 14. Light generated from the light source 14 reflects off the integrally formed reflector 12 and is distributed in a substantially square pattern.

The light source 14 is preferably a metal halide or a pressurized sodium lamp, details of which are well known to those skilled in the art so that further discussion herein is deemed unnecessary. The light source 14 has first and second ends 14*a*, 14*b*. FIG. 1 shows a light source 14 fully contained within reflector 12. The present invention is not so limited it being understood that second end 14*b* may extend beyond a second or bottom end 24.

The axis which defines the light source 14 aligns with the first or reflector axis 16 of the reflector so that the light center of the light source aligns with a focal point of the reflector 12. It has been shown that mounting the light source vertically as opposed to horizontally promotes a longer life and higher efficiency for metal halide light sources.

The reflector 12 includes a substantially closed first or top end 20 to which is mounted or secured the first end 14*a* of the light source 14. The second or bottom end 24 of the reflector is spaced from top end 20 and is substantially open to allow light to freely exit therefrom. Extending between and interconnecting the top end 20 and bottom end 24 is a side wall 26. The side wall 26 is formed symmetrically with respect to the first or reflector axis 16.

Figure 2:
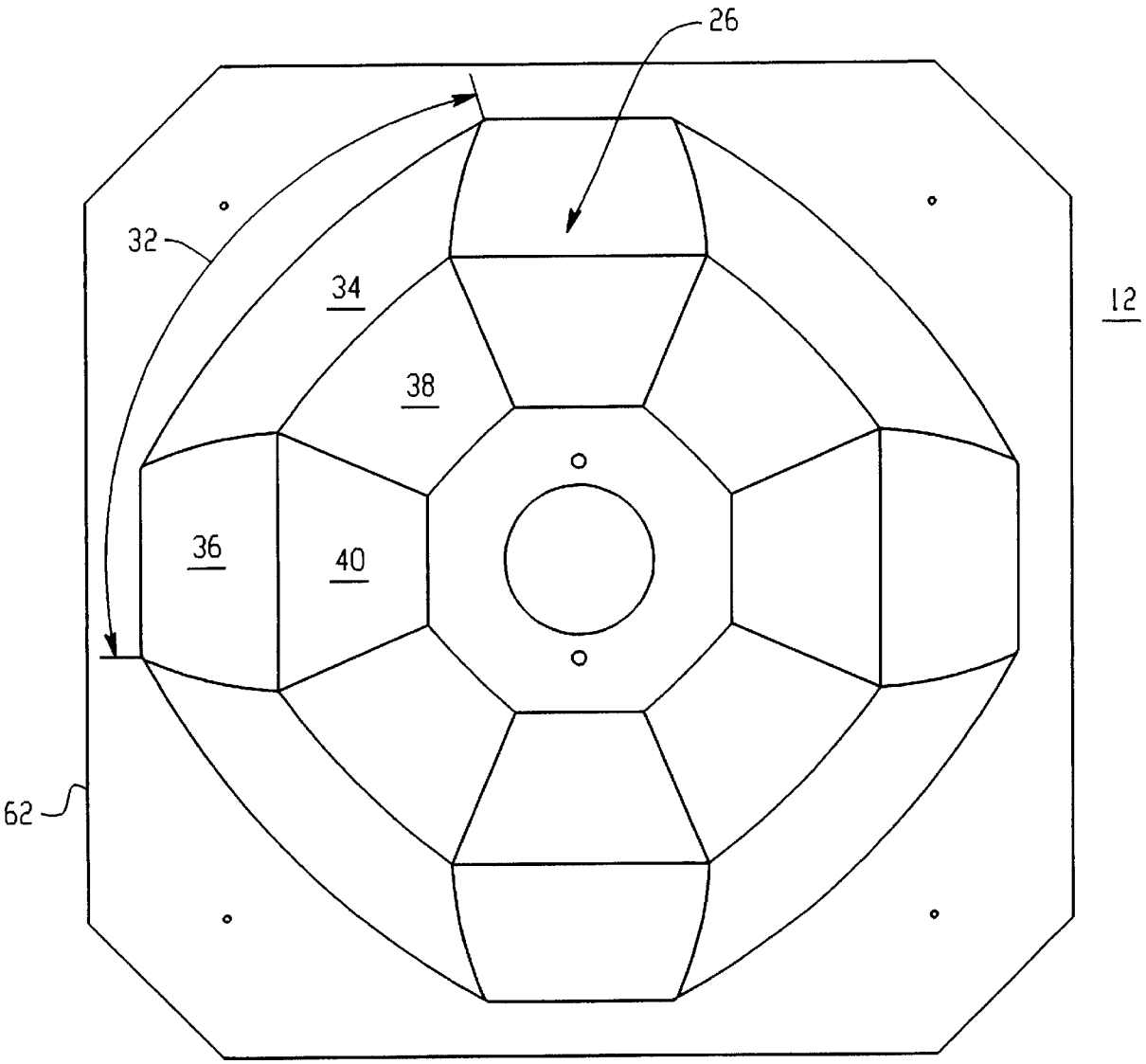
FIG. 2 is a plan view taken generally along the central axis of the lighting fixture of FIG. 1.

With reference to FIG. 2, the side wall 26 is formed symmetrically so that there are four generally equally shaped quadrants 32 each of which is further defined by four distinctly shaped sub-quadrants 34, 36, 38, 40. Since each of the quadrants are substantially identical to each other, description of the first quadrant 32 will be understood to be equally applicable to the remaining quadrants.

Figure 3:
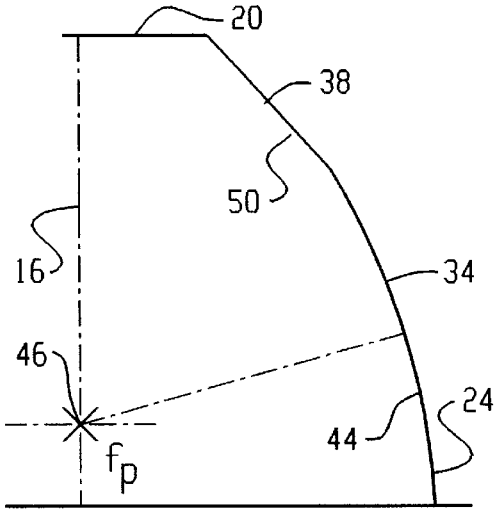
FIG. 3 is a cross-sectional view of the sub-quadrants.

With reference to FIG. 3, sub-quadrant 34 is defined by a surface 44 which is uniformaly paraboloidal. Each point on the surface 44 of the first sub-quadrant is located at an equal distance from a focus 46 which is centered in the light source 14. The paraboloid shape surface is designed and intended to distribute light from the source to a corner of the desired substantially square pattern of light.

FIG. 3 also shows a cross-sectional view of sub-quadrant 38 which connects sub-quadrant 34 to top end 20. Sub-quadrant 38 has a surface 50 which is substantially flat or planar in all surface directions. Surface 50 is designed to distribute light from the source to an inner portion of the substantially square pattern of light.

Figure 4:
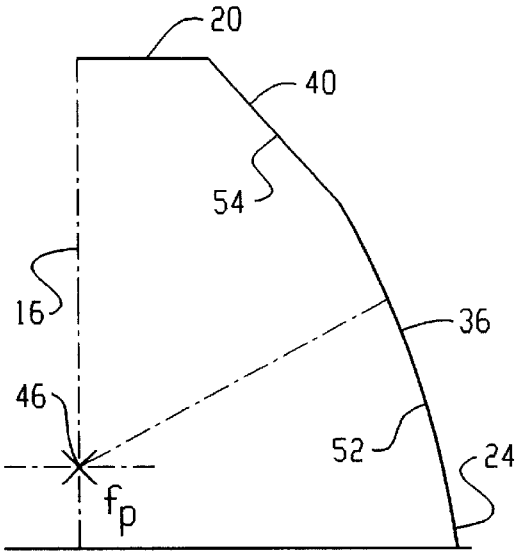
FIG. 4 is a cross-sectional view of the sub-quadrants.

FIG. 4 shows a cross-sectional view of sub-quadrants 36 and 40. Sub-quadrant 36 is defined by surface 52 which is paraboloidal in one surface direction and linear in a second surface direction where the first and second surface directions are transverse to each other. In particular, surface 52 is uniformaly paraboloidal from its top end to its bottom end while linear from side to side. Thus, each point on a surface line extending from top to bottom is equi distant from the focus 46. Points on a surface line extending from side to side may not be equi distant from the focus 46. Two points positioned on a line extending from side to side may be located at different lengths from the arc region of the source. Surface 52 is configured to distribute light from the source to the side portion of the substantially square output light pattern.

Sub-quadrant 40 is connected between the top end 20 and sub-quadrant 36. Surface 54 of the fourth sub-quadrant is substantially flat or planar in all surface directions and distributes light from the source to an inner portion of the substantially square light pattern.

Figure 5:
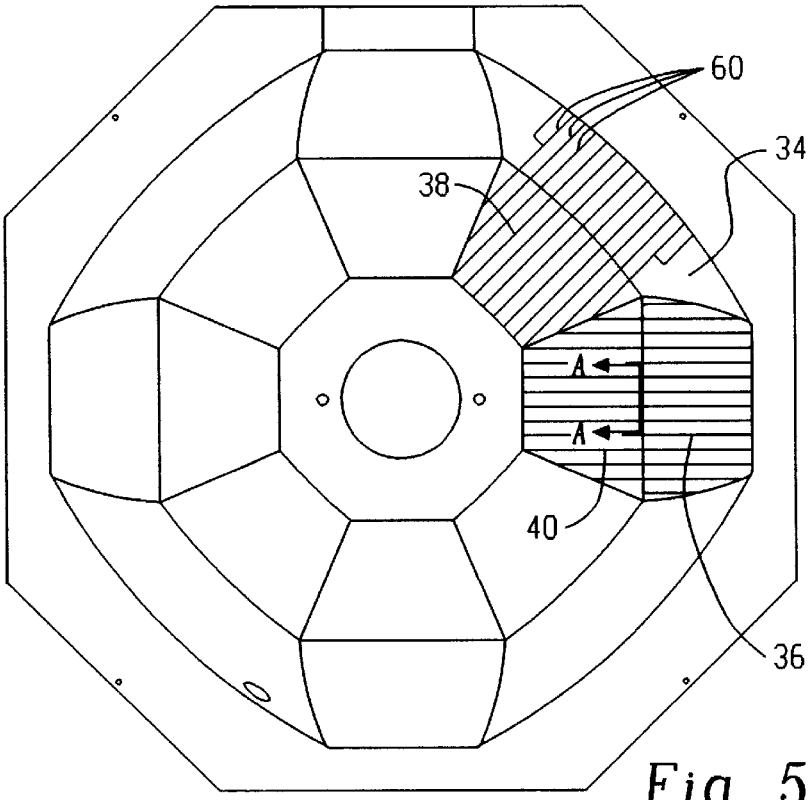
FIG. 5 is a plan view taken generally along the central axis of the lighting fixture of FIG. 1.
Figure 6:
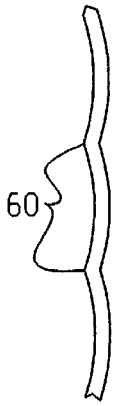
FIG. 6 is a cross-sectional view of a fluted sub-quadrant.

With reference to FIG. 5, a bottom view of the integrally formed reflector 12, small radii or flutes are formed on each of the surfaces of sub-quadrants 34–40. FIG. 5 shows only one quadrant as being fluted it being understood that the remaining quadrants are substantially identical. The surfaces of sub-quadrants 36–38 are completely covered by flutes while only a portion of the surface of sub-quadrant 34 is covered by flutes. The inventors have found that the corners of the square pattern light distribution can be enhanced or sharpened by not fully fluting sub-quadrant 34 as shown in FIG. 5. The flutes have ridges 60 which extend parallel to each other and function to diffuse and smooth light reflected therefrom.

The reflector 12 is integrally formed as one continuous, homogenous unit. This prevents manufacturing errors associated with fastening together several panels to form the reflector as is done in the prior art. The integrally formed reflector 12 can be formed using a standard tool and die machine. However, in the preferred embodiment, the integrally formed reflector 12 is formed using hydroforming machinery. The hydroforming machinery is basically a press. The hydroforming machine includes a male piece called a punch, which is machined to the exact inner surface shape of the reflector. In practice, a round flat piece of aluminum, called a blank, is placed upon a thick rubber diaphragm (the female part) which is pressurized on one side by a fluid such as oil. Once the thin aluminum blank is in place, the male punch is forced onto the aluminum blank. Continued force applied by the male punch shapes the thin aluminum blank to the pattern formed or machined on the male punch.

Once formed, the reflector is removed from the hydroforming machinery and trimmed using a trim press. It is to be noted, that a flange 62 extends from the bottom end of the reflector (FIG. 1). This flange is used for mounting the reflector into a housing (not shown). Moreover, an aperture or opening is formed in a central portion of the top end 20. This opening receives a socket into which the light source 14 is to be placed.

Once the reflector is formed, the inner surface is processed to protect it against corrosion. In one process, the inner surface is chemically brightened and coated. This is an anodizing process which is well-known in the art. In a second process, a thin layer of glass is deposited on an inner surface using a patented process called Alglass described in U.S. Pat. No. 3,499,780 which is incorporated herein by reference. After the inner surface is coated, an electrical assembly is connected to the fixture which includes a ballast and igniter starter and capacitor (not shown). Finally, the door, with lens is attached to the fixture. Additionally, a steel bracket is secured to the fixture which allows it to be mounted to, for example, a light pole.

The invention has been described with reference to the preferred embodiment. Obviously, modifications and alterations will occur to others upon reading and understanding the preceding detailed description. It is intended that the invention be construed as including such modifications and alterations insofar as they come within the scope of the appended claims or the equivalence thereof.

What we claim as new and desire to secure by Letters Patent of the United States is:

1. A lighting fixture comprising:

a light reflector, integrally formed as a single, continuous and homogeneous unit, for distributing a substantially square pattern of light, the light reflector having a top end including an aperture, a bottom end, and a side wall extending therebetween, wherein the side wall is formed substantially symmetrical with respect to a reflector axis and includes a plurality of similarly shaped sections, each section including a first sub-section having a first surface for distributing light from the source toward a corner portion of the substantially square pattern of light, a second sub-section having a second surface, for distributing light from the source toward a side portion of the substantially square pattern of light, and third and fourth sub-sections having third and fourth surfaces, respectively, for distributing light from the source toward interior portions of the substantially square pattern of light; and a light source, having a first end and a second end, attached to the top end of the light reflector, the first end and the second end extending along the reflector axis, light produced by the light source reflecting off the integrally formed reflector and being distributed in the substantially square pattern of light, the light source being received in the aperture of the top end thereby substantially closing the top end.

2. The lighting fixture of claim 1 wherein each of the first surfaces is a paraboloidal surface.

3. The lighting fixture of claim 1 wherein each of the first sub-section surfaces defines a focal point at a light center of the light source.

4. The lighting fixture of claim 3 wherein the each of the second sub-section surfaces defines a focal line extending through the light center of the light source and extending transverse to the reflector axis.

5. The lighting fixture of claim 4 wherein the first and second sub-sections of each section are positioned adjacently in a direction transverse to the reflector.

6. The lighting fixture of claim 5 wherein ridges are formed on the surfaces of each of the second and third sub-sections.

7. The lighting fixture of claim 6 wherein the ridges are formed on a portion of each of the first sub-sections.

8. The lighting fixture of claim 2 wherein each of the second surfaces is parabolic in a first surface direction.

9. The light fixture of claim 8 wherein each of the second surfaces is linear in a second surface direction, the second surface direction being transverse to the first surface direction.

10. The lighting fixture of claim 9 wherein each of the third and fourth surfaces is a planar surface.

11. The lighting fixture of claim 10 wherein the light reflector includes four similarly shaped sections.

12. The lighting fixture of claim 1 wherein the light source has a discharge area located on the reflector axis.

13. A square light distribution reflector comprising:

a top end including an aperture;

a bottom end; and a side wall, integrally formed as a single, continuous and homogeneous unit, extending between the top and bottom ends, the side wall including a plurality of similarly shaped sections, each section having a first sub-section having a first surface for distributing a corner portion of a substantially square pattern of light, a second sub-section having a second surface for distributing a side portion of the substantially square pattern of light, and third and fourth sub-sections having third and fourth surfaces, respectively, for distributing interior portions of the substantially square pattern of light, the light source being received in the aperture of the top end thereby substantially closing the top end.

14. The reflector of claim 13 wherein the side wall includes four sections.

15. The reflector of claim 14 wherein each first surface is a paraboloidal surface, each second surface is a surface which is uniformly parabolic in a first surface direction and linear in a second surface direction wherein the second surface direction is transverse to the first surface direction, and each of the third and fourth surfaces is a planar surface.

16. A square light distribution reflector comprising:

a top end;

a bottom end; and an integrally formed side wall extending between the top and bottom ends, the side wall including four similarly shaped quadrants, each quadrant having four distinctly shaped sub-quadrants including:

a first sub-quadrant, having a paraboloidal surface, for distributing a corner portion of a substantially square pattern of light;

a second sub-quadrant, having a surface which is uniformly parabolic in a first surface direction and linear in a second surface direction wherein the second surface direction is transverse to the first surface direction, for distributing a side portion of the substantially square pattern of light; and third and fourth sub-quadrants, each having a planar surface, for distributing interior portions of the substantially square pattern of light.

17. The square light distribution reflector of claim 16, wherein the side wall is formed substantially symmetrical with respect to a reflector axis; and wherein a space exists between the top end and the bottom end of the reflector for substantially containing a light source mounted along the reflector axis.

18. The square light distribution reflector of claim 17, wherein the reflector includes a focal point located at a light center of the light source;

wherein the second sub-quadrant has a top end and a bottom end, the top end and the bottom end of the second sub-quadrant being located between the top end and the bottom end, respectively, of the reflector; and wherein the first surface direction extends between the top end and the bottom end of the second sub-quadrant such that each point along a surface line extending from the top end of the second sub-quadrant to the bottom end of the second sub-quadrant is equidistant to the focal point.

19. The square light distribution reflector of claim 18, wherein the first and second sub-quadrants of each quadrant are positioned adjacently in a direction transverse to the reflector; and wherein the third and fourth sub-quadrants of each quadrant are positioned adjacently to the first and second sub-quadrants in a longitudinal direction of the reflector.

20. The square light distribution reflector of claim 19 wherein each surface of the four sub-quadrants is fluted.

* * * * *